US005664435A

United States Patent [19]

Bassuk

[11] Patent Number: 5,664,435

[45] Date of Patent: Sep. 9, 1997

[54] SEE-THROUGH REFRIGERATOR/FREEZER

[76] Inventor: Glenn Bassuk, 3009 Stinson Dr., Fort Wayne, Ind. 46816

[21] Appl. No.: 550,382

[22] Filed: Oct. 30, 1995

[51] Int. Cl.[6] ..... F25D 25/02

[52] U.S. Cl. ..... 62/381; 62/441

[58] Field of Search ..... 62/441, 381

[56] References Cited

U.S. PATENT DOCUMENTS

| | | | |
|---|---|---|---|
| 1,014,329 | 1/1912 | Pons | 62/441 |
| 1,887,419 | 11/1932 | Michel | 62/441 |
| 2,252,237 | 8/1941 | Stiles | 62/441 |
| 2,470,956 | 5/1949 | Savidge | 62/441 |
| 2,638,400 | 5/1953 | Spotts | 62/381 |
| 2,680,668 | 6/1954 | Stanfiel et al. | 62/381 |
| 2,761,751 | 9/1956 | Stockton | 62/381 |
| 3,769,805 | 11/1973 | Corini | 62/381 |
| 4,831,841 | 5/1989 | Falk | 62/381 |

*Primary Examiner*—William E. Tapolcai
*Attorney, Agent, or Firm*—Michael I. Kroll

[57] ABSTRACT

A see-through refrigerator/freezer is provided which consists of a cabinet having a plurality of compartments for storing food items therein and a plurality of transparent doors, each located in front of each compartment. A person can look into each compartment before opening the respective transparent door to retrieve the food items therefrom.

14 Claims, 4 Drawing Sheets

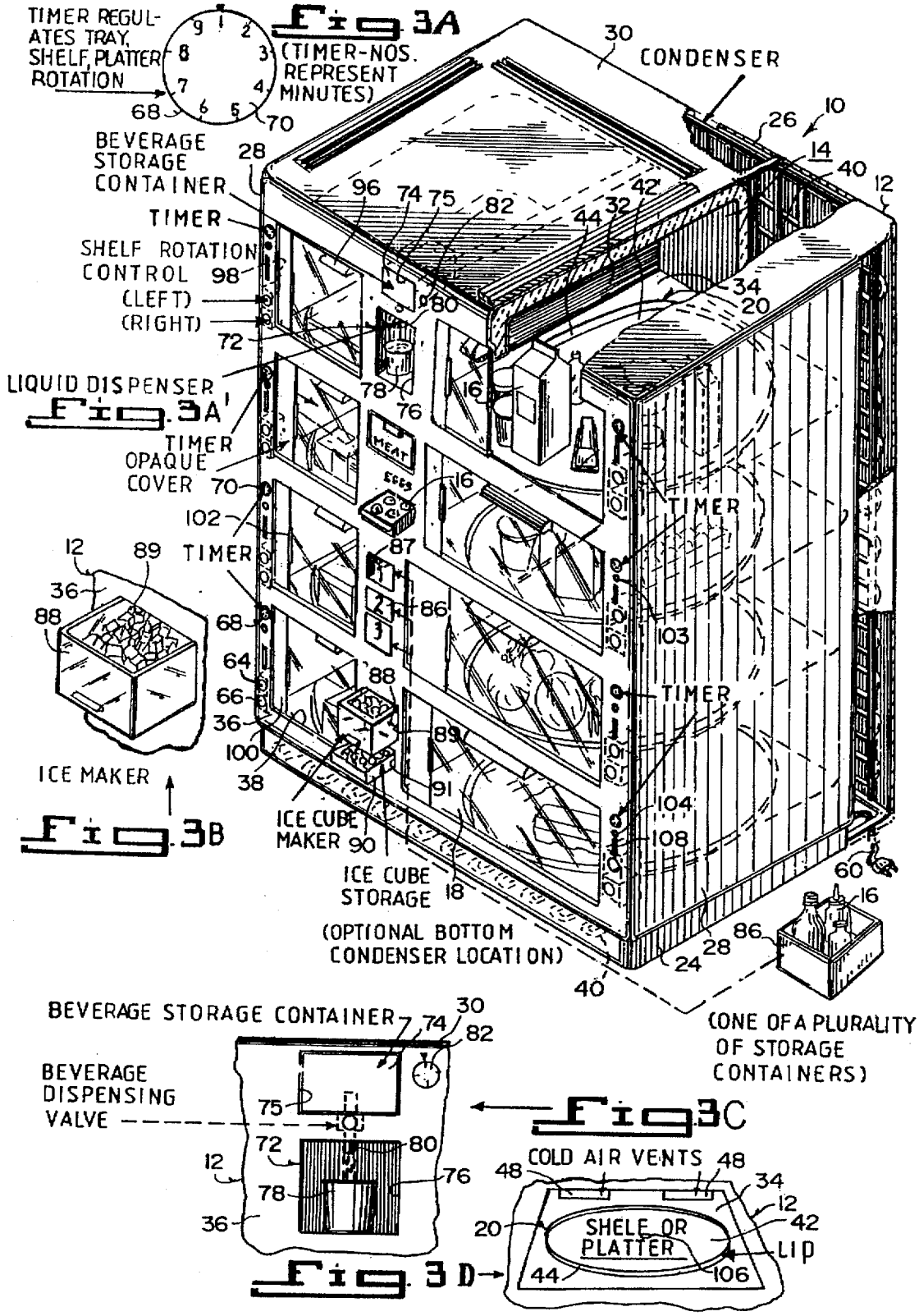
TIMER REGULATES TRAY, SHELF, PLATTER ROTATION
(TIMER-NOS. REPRESENT MINUTES)
Fig. 3A
CONDENSER
BEVERAGE STORAGE CONTAINER
TIMER
SHELF ROTATION CONTROL
(LEFT)
(RIGHT)
LIQUID DISPENSER
Fig. 3A'
TIMER
OPAQUE COVER
TIMER
TIMER
TIMER
ICE MAKER
Fig. 3B
ICE CUBE MAKER
ICE CUBE STORAGE
(OPTIONAL BOTTOM CONDENSER LOCATION)
(ONE OF A PLURALITY OF STORAGE CONTAINERS)
BEVERAGE STORAGE CONTAINER
BEVERAGE DISPENSING VALVE
Fig. 3C
COLD AIR VENTS
SHELF OR PLATTER
LIP
Fig. 3D 96
30
38
68
104
18
36
10
22
92
64
66
70
103
28
108
12
14
6
52
54
46
20
34
32
7

DRIVE MOTOR
44
42
50
56
58

PERIMETER BALL BEARING

SEE-THROUGH REFRIGERATOR/FREEZER

BACKGROUND OF THE INVENTION

1. Field of the Invention

The instant invention relates generally to storage cabinets and more specifically it relates to a see-through refrigerator/freezer.

2. Description of the Prior Art

Numerous storage cabinets have been provided in prior art that are adapted to keep substances, such as food, at low temperatures so that the food will not spoil. While these units may be suitable for the particular purpose to which they address, they would not be as suitable for the purposes of the present invention as heretofore described.

SUMMARY OF THE INVENTION

A primary object of the present invention is to provide a see-through refrigerator/freezer that will overcome the shortcomings of the prior art devices.

Another object is to provide a see-through refrigerator/freezer that contains a plurality of compartments for storing food therein and a transparent door located in front of each compartment, so that a person can look into each compartment before opening its door to retrieve the food therefrom.

An additional object is to provide a see-through refrigerator/freezer in which a rotatable shelf is located within each compartment to hold food thereon, so that a person can operate each shelf from the front to retrieve a desired food item therefrom.

A further object is to provide a see-through refrigerator/freezer that is simple and easy to use.

A still further object is to provide a see-through refrigerator/freezer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 3A is an enlarged front view of one of the timer dials in greater detail.

Figures 1, 1A, 2, 3:
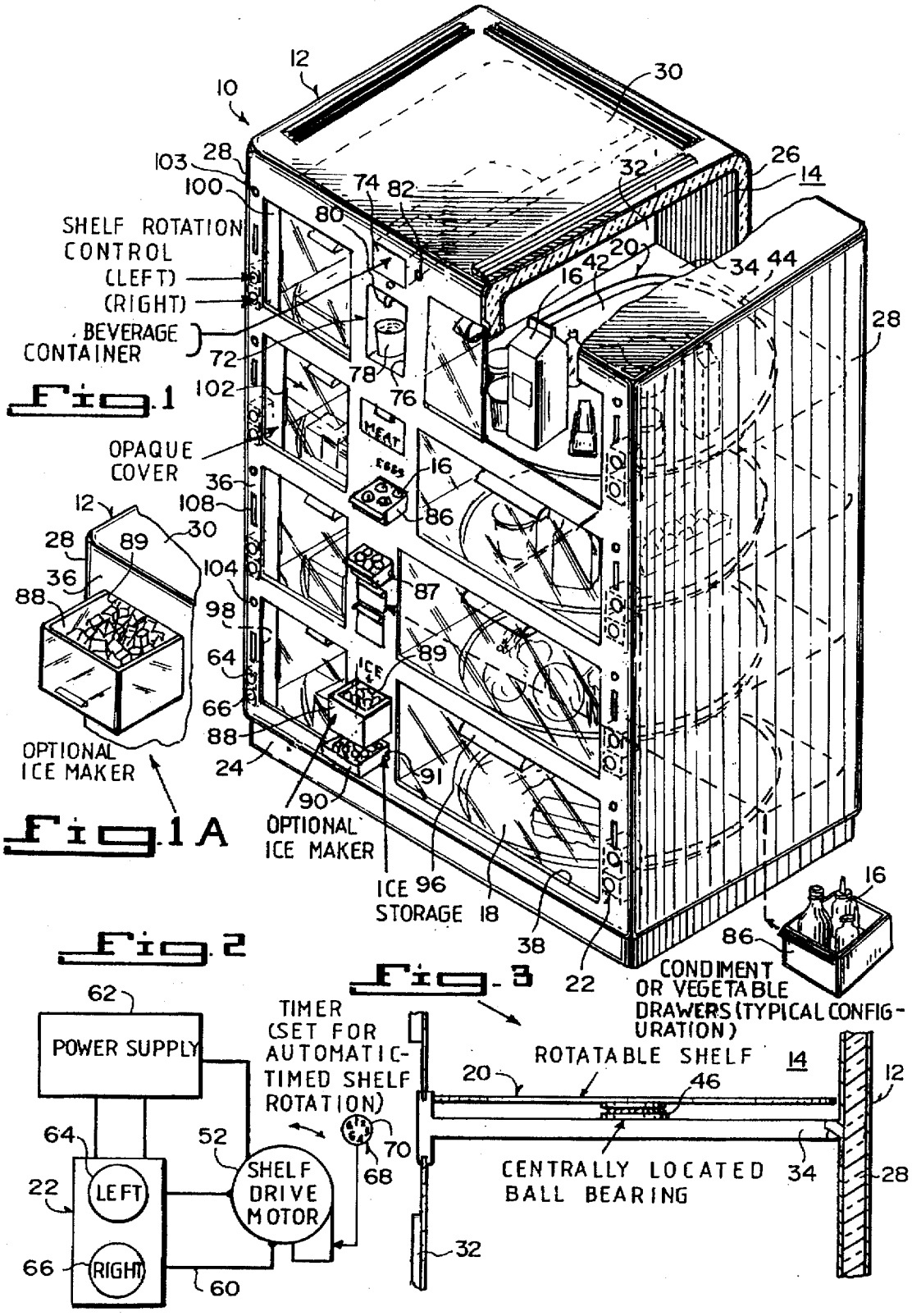
FIG. 1 is a perspective view with parts broken away of a first embodiment of the instant invention.
FIG. 1A is an enlarged perspective view of the optional ice maker located in the upper left hand corner of the first embodiment.
FIG. 2 is a block diagram of the electrical circuit to operate one of the rotatable shelves.
FIG. 3 is a partial cross sectional view showing one of the rotatable shelves.
Figure 1B:
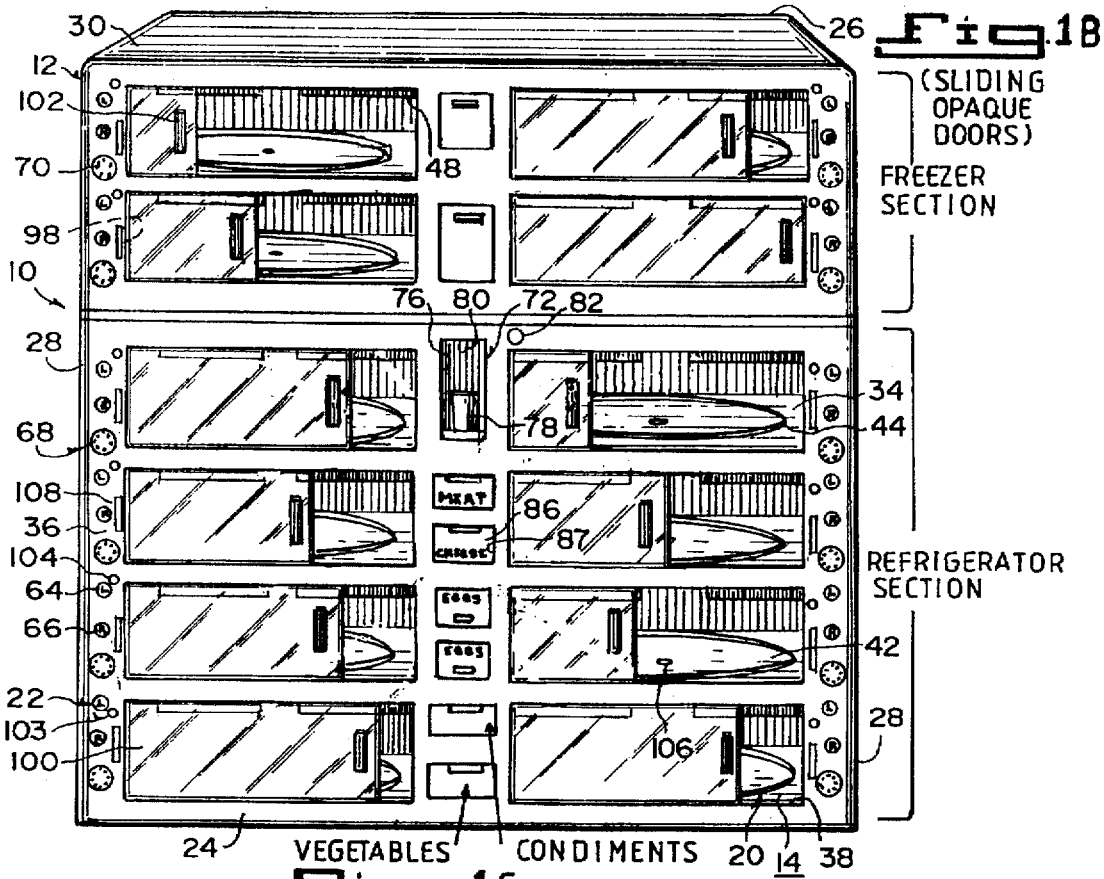
FIG. 1B is a perspective view of a second embodiment.
Figure 1C:
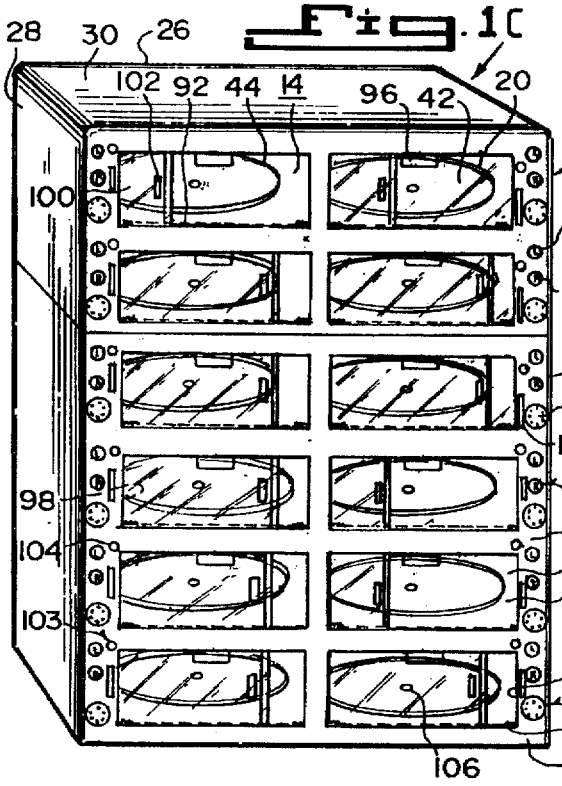
FIG. 1C is a perspective view of a third embodiment.
Figure 1D:
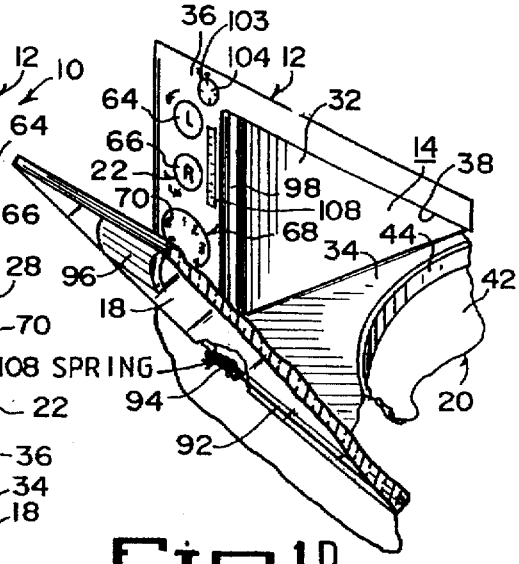
FIG. 1D is an enlarged perspective view with parts broken away showing one of the doors partly opened in the third embodiment.

FIG. 3A' is a perspective view with parts broken away of a fourth embodiment.

FIG. 3B is an enlarged perspective view of the ice maker in the fourth embodiment.

FIG. 3C is an enlarged front view of a portion of the fourth embodiment showing the beverage dispenser in greater detail.

FIG. 3D is a diagrammatic perspective view of the interior of one of the compartments in the fourth embodiment.

Figures 4, 5, 6, 7, 8:
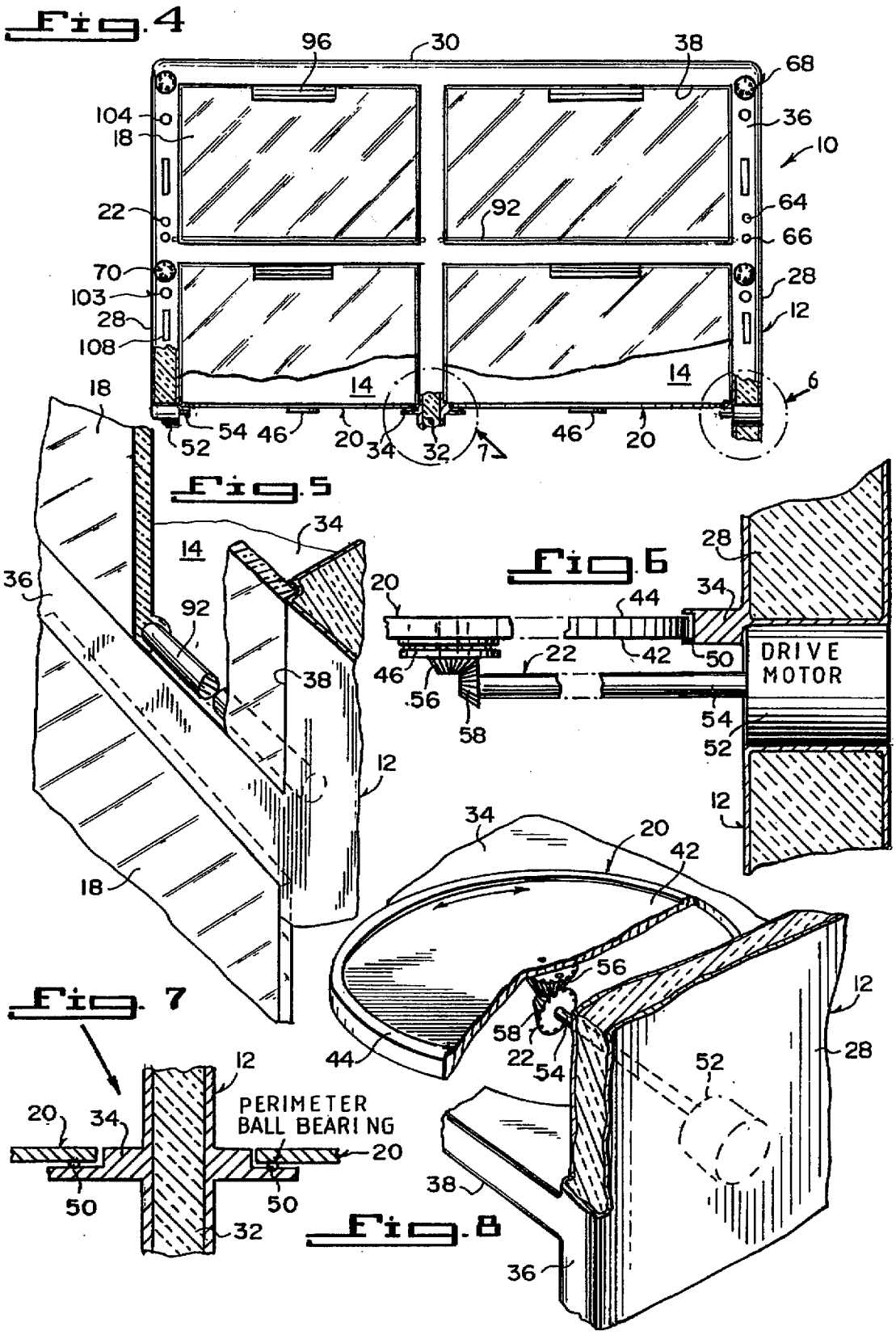

FIG. 4 is a front view with parts broken away of a fifth embodiment.

FIG. 5 is an enlarged perspective view of a portion of the fifth embodiment partly in section showing one of the door hinges in greater detail.

FIG. 6 is an enlarged cross sectional view as indicated by arrow 6 in FIG. 4.

FIG. 7 is an enlarged cross sectional view as indicated by arrow 7 in FIG. 4.

FIG. 8 is an enlarged perspective view with parts broken away and in section showing the drive mechanism for one of the rotatable shelves in the fifth embodiment.

DETAILED DESCRIPTION OF THE PREFERRED EMBODIMENTS

Turning now descriptively to the drawings, in which similar reference characters denote similar elements throughout the several views, the Figures illustrate a see-through refrigerator/freezer 10, which consists of a cabinet 12 having a plurality of compartments 14 for storing food items 16 therein and a plurality of transparent doors 18, each located in front of each compartment 14. A person can look into each compartment 14 before opening the respective transparent door 18 to retrieve the food items 16 therefrom.

The see-through refrigerator/freezer 10 further includes a plurality of rotatable shelves 20, each located within each compartment 14 in the cabinet 12. A mechanism 22 is for rotating each rotatable shelf 20 by the person, so that the person can better retrieve the desired food items 16 therefrom.

The cabinet 12 includes an insulated bottom wall 24. An insulated back wall 26 extends upwardly from the insulated bottom wall 24. A pair of insulated side walls 28 are provided, with each extending upwardly from the insulated bottom wall 24. An insulated top wall 30 extends over the insulated back wall 26 and the insulated side walls 28. An insulated interior vertical partition 32 extends upwardly between the insulated bottom wall 24 and the insulated top wall 30. A plurality of insulated interior horizontal partitions 34 are also provided, with each spaced apart and extending between the insulated side wall 28, thereby forming each compartment 14 therein. An insulated front wall 36 extends upwardly between the insulated bottom wall 24 and the insulated top wall 30. The insulated front wall 36 has a plurality of openings 38, each located at each of the compartments 14, so as to retain one of the transparent doors 18 thereat.

The cabinet 12 further includes a condenser 40 located in the insulated bottom wall 24 and the insulated back wall 26 to keep the food items 16 at a proper temperature to prevent spoilage. Each rotatable shelf 20 is a circular plate 42 having an annular lip 44 about its perimeter to prevent the food items 16 thereon from falling off the circular plate 42.

Each rotatably shelf 20 includes a centrally located ball bearing assembly 46 to rotatably support the rotatable shelf 20 on one insulated interior horizontal partition 34 within one compartment 14. Each compartment 14 contains at least one air vent 48 to allow the proper air temperature to enter the compartment 14.

Each rotatable shelf 20 further includes a perimeter ball bearing assembly 50 to rotatably support the perimeter of the circular plate 42 on one insulated interior horizontal partition 34 within one compartment 14.

Each rotating mechanism 22 includes an electric drive motor 52 having a drive shaft 54. The drive motor 52 is mounted within one insulated side wall 28 of the cabinet 12. The drive shaft 54 extends into the cabinet 12 below one insulated interior horizontal partition 34. A pair of intersecting bevel gears 56 and 58 are provided, in which the first bevel gear 56 is connected to the underside at the center of the circular plate 42 of the rotatable shelf 20. The second bevel gear 58 is connected to a distal end of the drive shaft 54 of the drive motor 52, so that the drive motor 52 can rotate the rotatable shelf 20.

An electric circuit 60 is electrically connected to the electric drive motor 52. A power supply 62 is electrically connected to the electric circuit 60. A first switch button 64 is mounted to the insulated front wall 36 of the cabinet 12 and is electrically connected to the electric circuit 60 for rotating the rotatable shelf 20 in a left direction. A second switch button 66 is mounted to the insulated front wall 36 of the cabinet 12 and is electrically connected to the electric circuit 60 for rotating the rotatable shelf 20 in a right direction.

A timer 68 can also be electrically connected to the electric circuit 60. The timer 68 has a dial 70 mounted to the insulated front wall 36 of the cabinet 12 for automatically setting the time for rotating the rotatable shelf 20 to insure that all of the food items 16 on the rotatable shelf 20 will receive the proper air temperature.

A liquid dispenser 72 is mounted in the insulated front wall 36 of the cabinet 12, so that the person can obtain a cold beverage therefrom without opening any of the transparent doors 18. The liquid dispenser 72 includes a beverage storage container 74 that slides into an aperture 75 in the insulated front wall 36 of the cabinet 12. A receiving receptacle 76 for a beverage cup 78 is formed into the insulated front wall 36 of the cabinet 12 below the beverage storage container 74. A beverage dispensing valve 80 is located in the insulated front wall 36 of the cabinet 12 between the beverage storage container 74 and the receiving receptacle 76. A temperature control dial 82 is mounted to the insulated front wall 36 to regulate the desired coldness of the beverage dispensed from the storage container 74.

A plurality of storage containers/drawers 86 can slide into apertures 87 in the insulated front wall 36 of the cabinet 12, so that each storage container/drawer 86 can hold different types of food items 16 therein.

An ice cube maker 88 can be provided, which slides into an aperture 89 in the insulated front wall 36 of the cabinet 12. An ice cube storage compartment 90 can also be provided, which slides into an aperture 91 in the insulated front wall 36 of the cabinet 12 directly below the ice cube maker 88.

Each transparent door 18 contains a shaft 92 extending through a lower edge thereof and into the sides of the opening 38, so that the transparent door 18 can open downwardly therefrom. A spring 94 is on the shaft 92 for biasing the transparent door 18 in a closed position. An upper handle 96 is on an upper edge of the transparent door 18, so that the person can grip the upper handle 96 to open the transparent door 18.

Each transparent door 18 can also include a track 98 formed within the opening 38. A flexible opaque cover 100 can slide in the track 98 to block out the food items 16 therein. A side handle 102 is on a side edge of the flexible opaque cover 100, so that the person can grip the side handle 102 to open and close the flexible opaque cover 100, while the transparent door 18 is closed.

Each compartment 14 contains a thermostat 103 with a dial 104 mounted to the insulated front wall 36 of the cabinet 12 and is electrically connected to the electric circuit 60. The thermostat dial 104 can be turned by the person to control the degree of coldness for the food items 16 within the compartment 14. A temperature sensor 106 is mounted to the rotatable shelf 20 and is electrically connected to the thermostat 103 to determine the temperature within the compartment 14. A temperature gauge 108 is mounted to the insulated front wall 36 of the cabinet 12 and is electrically connected to the temperature sensor 106 to visually indicate the temperature within the compartment 14.

LIST OF REFERENCE NUMBERS

10 see-through refrigerator/freezer
12 cabinet
14 compartment in 12
16 food item
18 transparent door
20 rotatable shelf in 14
22 rotating mechanism
24 insulated bottom wall of 12
26 insulated back wall of 12
28 insulated side wall of 12
30 insulated top wall of 12
32 insulated interior vertical partition of 12
34 insulated interior horizontal partition of 12
36 insulated front wall of 12
38 opening in 36
40 condenser in 24 and 26
42 circular plate
44 annular lip on 42
46 ball bearing assembly
48 air vent in 14
50 perimeter ball bearing assembly
52 electric drive motor
54 drive shaft of 52
56 first bevel gear on 42
58 second bevel gear on 54
60 electric circuit
62 power supply
64 first switch button (left)
66 second switch button (right)
68 timer
70 timer dial on 36
72 liquid dispenser in 36
74 beverage storage container
75 aperture in 36
76 receiving receptacle in 36
78 beverage cup
80 beverage dispensing valve in 36
82 temperature control dial on 36
86 storage container/drawer
87 aperture in 36
88 ice cube maker
89 aperture in 36
90 ice cube storage compartment
91 aperture in 36
92 shaft for 18
94 spring on 92
96 upper handle on 18
98 track in 38
100 flexible opaque cover

102 side handle on 100
103 thermostat
104 thermostat dial on 36
106 temperature sensor on 20
108 temperature gauge on 36

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A see-through refrigerator/freezer which comprises:

a) a cabinet having:

i) a plurality of compartments for storing food items therein;

ii) an insulated bottom wall;

iii) an insulated back wall extending upwardly from said insulated bottom wall;

iv) a pair of insulated side walls, each extending upwardly from said insulated bottom wall;

v) an insulated top wall extending over said insulated back wall and said insulated side walls;

vi) an insulated interior vertical partition extending upwardly between said insulated bottom wall and said insulated top wall;

vii) a plurality of insulated interior horizontal partitions, each spaced apart and extending between said insulated side walls thereby forming each said compartment therein;

viii) an insulated front wall extending upwardly between said insulated bottom wall and said insulated top wall, said insulated front wall having a plurality of openings, each located at each of said compartments, so as to retain one of said transparent doors thereat; and ix) a evaporator located in said insulated bottom wall and said insulated back wall to keep the food items at a proper temperature to prevent spoilage;

b) a plurality of transparent doors, each located in front of each said compartment, so that a person can look into each said compartment before opening said respective transparent door to retrieve the food items therefrom;

c) a plurality of rotatable shelves, each located within a compartment in said cabinet and each being a circular plate having an annular lip about its perimeter to prevent the food items thereon from falling off said circular plate; and d) means for rotating each said rotatable shelf by the person, so that the person can better retrieve the desired food item therefrom, said rotating means including a centrally located ball bearing assembly to rotatably support said rotatable shelf on one said insulated interior horizontal partition within one said compartment.

2. A see-through refrigerator/freezer as recited in claim 1, wherein each said compartment includes at least one air vent to allow the proper air temperature to enter said compartment.

3. A see-through refrigerator/freezer as recited in claim 2, wherein each said rotatable shelf further includes a perimeter ball bearing assembly to rotatably support the perimeter of said circular plate on one said insulated interior horizontal partition within one said compartment.

4. A see-through refrigerator/freezer as recited in claim 3, wherein each said rotating means includes:

a) an electric drive motor having a drive shaft, said drive motor mounted within one said insulated side wall of said cabinet, so that said drive shaft extends into said cabinet below one said insulated interior horizontal partition; and b) a pair of intersecting bevel gears, in which said first bevel gear is connected to the underside at the center of said circular plate of said rotatable shelf and said second bevel gear is connected to a distal end of said drive shaft of said drive motor, so that said drive motor can rotate said rotatable shelf.

5. A see-through refrigerator/freezer as recited in claim 4, wherein each said rotating means further includes:

a) an electric circuit electrically connected to said electric drive motor;

b) a power supply electrically connected to said electric circuit;

c) a first switch button mounted to said insulated front wall of said cabinet and electrically connected to said electric circuit for rotating said rotatable shelf in a left direction; and d) a second switch button mounted to said insulated front wall of said cabinet and electrically connected to said electric circuit for rotating said rotatable shelf in a right direction.

6. A see-through refrigerator/freezer as recited in claim 5, wherein each said rotating means further includes a timer electrically connected to said electric circuit, said timer having a dial mounted to said insulated front wall of said cabinet for automatically setting the time for rotating said rotatable shelf to insure that all of the food items on said rotatable shelf will receive the proper air temperature.

7. A see-through refrigerator/freezer as recited in claim 6, further including a liquid dispenser mounted in said insulated front wall of said cabinet, so that the person can obtain a cold beverage therefrom without opening any of said transparent doors.

8. A see-through refrigerator/freezer as recited in claim 7, wherein said liquid dispenser includes:

a) a beverage storage container that slides into an aperture in said insulated front wall of said cabinet;

b) a receiving receptacle for a beverage cup formed into said insulated front wall of said cabinet below said beverage storage container;

c) a beverage dispensing valve located in said insulated front wall of said cabinet between said beverage storage container and said receiving receptacle; and d) a temperature control dial mounted to said insulated front wall to regulate the desired coldness of the beverage dispensed from said storage container.

9. A see-through refrigerator/freezer as recited in claim 8, further including a plurality of storage containers/drawers, each of which slides into an aperture in said insulated front wall of said cabinet, so that each said storage container/drawer can hold different types of food items therein.

10. A see-through refrigerator/freezer as recited in claim 9, further including an ice cube maker which slides into an aperture in said insulated front wall of said cabinet.

11. A see-through refrigerator/freezer as recited in claim 10, further including an ice cube storage compartment which slides into an aperture in said insulated front wall of said cabinet directly below said ice cube maker.

12. A see-through refrigerator/freezer as recited in claim 11, wherein each said transparent door includes:

a) a shaft extending through a lower edge thereof and into the sides of said opening, so that said transparent door can open downwardly therefrom;

b) a spring on said shaft for biasing said transparent door in a closed position; and c) an upper handle on an upper edge of said transparent door, so that the person can grip said upper handle to open said transparent door.

13. A see-through refrigerator/freezer as recited in claim 12, wherein each said transparent door includes:

a) a track formed within said opening;

b) a flexible opaque cover that can slide in said track to block out the food items therein; and c) a side handle on a side edge of said flexible opaque cover, so that the person can grip said side handle to open and close said flexible opaque cover while said transparent door is closed.

14. A see-through refrigerator/freezer as recited in claim 13, wherein each said compartment includes:

a) a thermostat with a dial mounted to said insulated front wall of said cabinet and electrically connected to said electric circuit, so that said thermostat dial can be turned by the person to control the degree of coldness for said food items within said compartment;

b) a temperature sensor mounted to said rotatable shelf and electrically connected to said thermostat dial to determine the temperature within said compartment; and c) a temperature gauge mounted to said insulated front wall of said cabinet and electrically connected to said temperature sensor to visually indicate the temperature within said compartment.

* * * * *